US006500082B1

(12) United States Patent
Ou

(10) Patent No.: US 6,500,082 B1
(45) **Date of Patent: *Dec. 31, 2002**

(54) AMERICAN FOOTBALL SUPPORTED WITH CONSTRUCTION LINER

(76) Inventor: Tsung Ming Ou, 6F-3, No. 182, Chung Cheng 2nd Road, Kaohsiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/332,261

(22) Filed: Jun. 11, 1999

(51) Int. Cl.[7] ..... A63B 41/10
(52) U.S. Cl. ..... 473/599; 473/603
(58) Field of Search ..... 473/601, 605, 473/614, 615, 596, 597, 598, 599, 148, 155, 159, 167; 156/145, 146, 147, 242, 245

(56) References Cited

U.S. PATENT DOCUMENTS 601,520 A * 3/1898 Longden ..... 473/603
2,653,818 A * 9/1953 Tebbetts ..... 473/604
2,665,132 A * 1/1954 Robinson ..... 473/599
2,700,545 A * 1/1955 Axton ..... 473/599
3,256,019 A * 6/1966 Barton ..... 473/597
3,506,265 A * 4/1970 Yugi ..... 473/604
3,512,777 A * 5/1970 Henderson ..... 473/597
4,169,594 A * 10/1979 Crane ..... 473/604
4,305,583 A * 12/1981 Tandon ..... 473/609
4,660,831 A * 4/1987 Kralik ..... 473/603
4,998,728 A * 3/1991 Traub ..... 473/605
5,759,123 A * 6/1998 Ou ..... 473/599

* cited by examiner

*Primary Examiner*—Steven Wong
(74) *Attorney, Agent, or Firm*—Raymond Y. Chan; David & Raymond Patent Group

(57) ABSTRACT

An American football, which is made by vulcanization a rubber piece with two fabric linings, is strong enough to provide a more durable American football with better supporting but lower manufacturing cost. The American football includes a ball cover having a valve hole thereon and an inflatable bladder disposed within the ball cover for propping up the ball cover after inflation. The inflatable bladder has a predetermined shape and a valve stem mounted thereon and extended through the valve hole of the ball cover. The ball cover includes four elliptical cover pieces sewn edge to edge together. Each of the cover pieces includes an outer elliptical cover skin and an inner elliptical construction liner which is overlappedly attached on an inside of the cover skin for supporting the cover skin and enclosing the inflatable bladder. Each of the construction liners has a rubber piece of predetermined thickness vulcanizing with at least a fabric lining to form an integral liner piece having a size and shape at least equal to the outer cover skin.

10 Claims, 2 Drawing Sheets

AMERICAN FOOTBALL SUPPORTED WITH CONSTRUCTION LINER

BACKGROUND OF THE PRESENT INVENTION

1. Field of the Invention

The present invention relates to American football, and more particularly to a more durable American football which is supported with construction liner for better supporting with lower manufacturing cost.

2. Description of Related Arts

American football is one of the most popular sports in United States. The conventional American football generally comprises a hollow outer ball carcass and an inflatable bladder disposed within the ball carcass for propping up the ball carcass after inflation. The inflatable bladder can be made of rubber or polyurethane when leather made ball carcass is used. The ball carcass of the American football comprises a plurality of cover pieces sewn edge to edge together to form an ellipsoidal shape. Each of the cover pieces comprises an outer cover skin and an inner liner for supporting between the outer cover and the inflatable rubber bladder. One of the most common materials of the outer cover skin is leather. Synthetic leather, such as polyvinyl chloride (PVC) or polyurethane (PU), is another common material for the outer cover skin because of its toughness nature that is more suitable for sewing. Besides, padded cover pieces are suggested in U.S. Pat. Nos. 4,462,590 and 4,660,831.

Generally speaking, if the ball carcass is made of leather, no backing is required. However, for polyvinyl chloride made ball carcass, woven fabric backing is attached on its inner surface for reinforcing and supporting. Also, for polyurethane made ball carcass, non-woven fabric is attached on its inner surface for reinforcing and supporting.

The liner of all the conventional American football can be of woven fabric, such as twilled nylon, cotton or other mixing material such as TC, TR, is preferably about 0.038 cm thick. To produce the conventional liner, a polyvinyl chloride or polyurethane layer and at least two lining layers are pressed to adhere on both sides of the polyvinyl chloride or polyurethane layer by feeding through a pair of pressing rollers to form a bolt of lining cloth. Pieces of inner liner with elliptical shape are cut from this lining cloth.

However, it is well known that the conventional American football is quite stiff to grip, catch and hold. It is because the inner liner, made of polyurethane and woven fabric layers adhered with each other, must be strong enough to support the softer outer cover skin to tolerate impact and to retain the ellipsoidal shape of the American football.

SUMMARY OF THE PRESENT INVENTION

It is a main object of the present invention to provide an American football supported with improved construction liner which is made by vulcanization layers of rubber and fabric lining and is strong enough to provide a more durable American football with better supporting but lower manufacturing cost.

Another object of the present invention is to provide an American football wherein the stiffness and softness of the football can be designated by adjusting the thickness of the rubber piece of the construction liner thereof and/or the number of layers of the rubber piece and the fabric lining, so that different types of American football with different levels of softness and stiffness can easily be made for fitting different types of playground and different ages of players. For example, the American football for junior players may have softer ball carcass and the American football for professional players may have stiffer ball carcass.

In order to accomplish the above objects, the present invention provides an American football supported with construction liner, comprising a ball cover having a valve hole thereon and an inflatable bladder disposed within the ball cover for propping up the ball cover after inflation.

The inflatable bladder has a predetermined shape and a valve stem mounted hereon and extended through the valve hole of the ball cover. The ball cover comprises our elliptical cover pieces sewn edge to edge together. Each of the cover pieces comprises an outer elliptical cover skin made of leather or synthetic leather, such as polyvinyl chloride (PVC) or polyurethane (PU), and an inner elliptical construction liner which is overlappedly attached on an inside of the cover skin for supporting the cover skin and enclosing the inflatable bladder.

Each of the construction liners comprises a rubber piece of predetermined thickness vulcanizing with at least a fabric lining to form an integral liner piece having a size and shape at least equal to the outer cover skin.

The construction liner of each cover pieces of the ball cover of the American football according to the present invention is made by a specific method comprising the steps of:

(a) cutting a rubber sheet material into elliptical rubber pieces of a predetermined size;

(b) cutting a fabric sheet material into elliptical fabric linings having a same size of the rubber piece;

(c) compressing and vulcanizing each of the rubber pieces with one of the fabric linings together in a press mold, so as to firmly united the rubber piece with the fabric lining integrally to form a rubber-based fabric liner; and (d) cutting each of the rubber-based fabric liners to a predetermined size.

DETAILED DESCRIPTION OF THE PREFERRED EMBODIMENT

Figure 1:
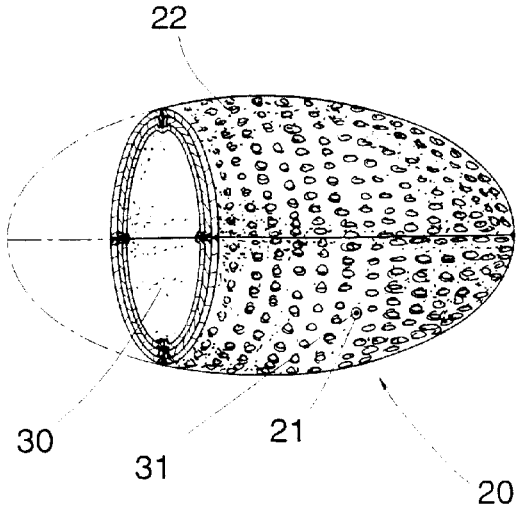
FIG. 1 is a partial sectional perspective view of an American football supported with construction liner according to a preferred embodiment of the present invention.
Figure 2:
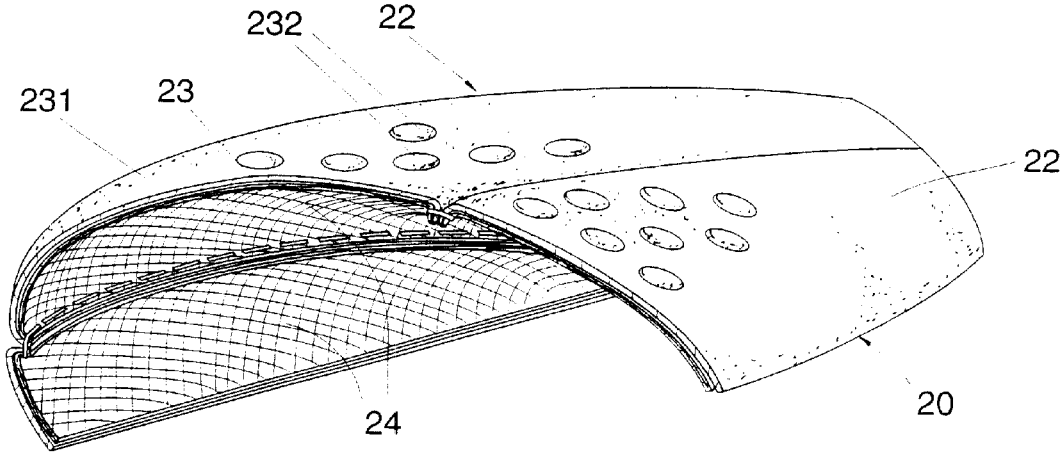
FIG. 2 is an enlarged partial sectional perspective view of the American football supported with construction liner according to the above preferred embodiment of the present invention.

Referring to FIGS. 1 and 2, an American football supported with construction liner according to the preferred embodiment of the present invention is illustrated. The American football comprises a ball cover 20 having a valve hole 21 thereon and an inflatable bladder 30 disposed within the ball cover 20 for propping up the ball cover 20 after inflation.

The inflatable bladder 30, which is generally made of rubber or polyurethane, has a predetermined shape and a valve stem 31 mounted thereon and extended through the valve hole 21 of the ball cover 20. The ball cover 20 comprises four elliptical cover pieces 22 sewn edge to edge together. Each of the cover pieces 22 comprises an outer elliptical cover skin 23 and an inner elliptical construction liner 24 which is overlappedly attached on an inside of the cover skin 23 for supporting the cover skin 23 and enclosing the inflatable bladder 30. The outer elliptical cover skin 23 of each of the cover pieces 22 is made of leather, or synthetic leather such as polyvinyl chloride (PVC) or polyurethane (PU) with or without foaming material for backing.

Each of the construction liners 24 comprises a rubber piece 241 of predetermined thickness and at least a fabric lining 242 integrally combined with the rubber piece 241 by compressing and vulcanizing to form an integral liner piece having a size and shape at least equal to the outer cover skin 23.

As shown in FIGS. 1 and 2, a top surface 231 of the cover skin 23 provides a plurality of protruding pebbles 232 evenly distributed all over the top surface 231, so as to facilitate the gripping and holding of the American football by the players. However, the conventional American football is stiffened by the conventional PU liner attached to the inside of the cover skin that degrades the gripping and holding effects of the American football during gripping, catching, transferring, flowing, and holding the American football. In other words, the conventional American football supported with stiff PU liner fails to provide softer and less stiff properties for junior players or when better gripping and holding effects or specific circumstances are needed.

Figure 3:
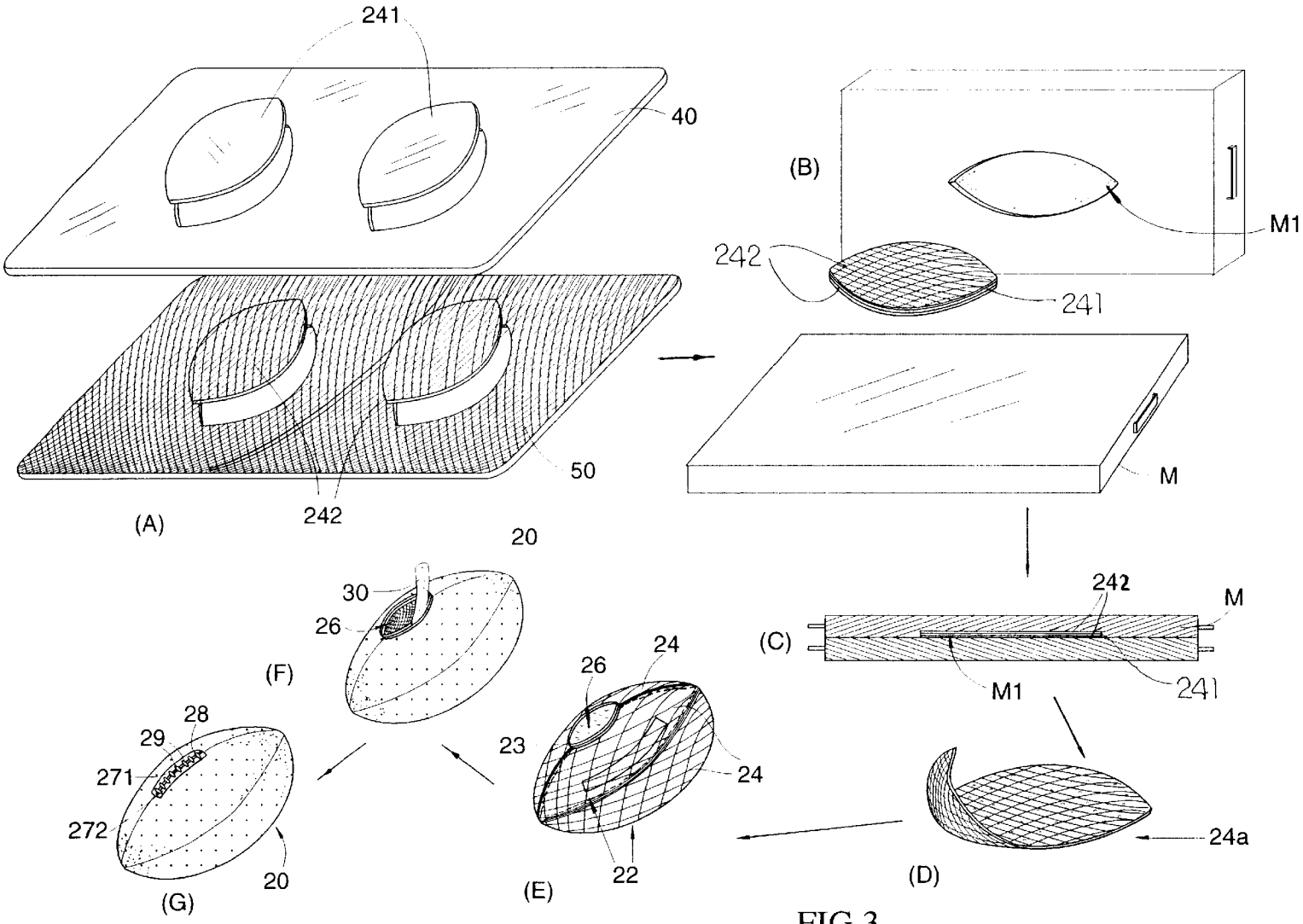
FIG. 3 is an illustrating view of a method for producing the construction liner for the American football according to the above preferred embodiment of the present invention.

According to the present invention, as shown in FIG. 3 , the construction liner 24 of each cover pieces 22 of the ball cover 20 of the American football is made by a specific method comprising the following steps.

(a) Cut a rubber sheet material 40 into elliptical rubber pieces 241 having a predetermined size, as shown in FIG. 3(A).

(b) Cut a fabric sheet material 50 into elliptical fabric linings 242 having a same size of the rubber piece 241, as shown in FIG. 3(A).

(c) Compress and vulcanize at least one of the rubber pieces 241 with at least one of the fabric linings 242 together in a press mold M with heat applied, so as to firmly united the rubber piece 241 with the fabric lining 242 integrally to form a rubber-based fabric liner 24*a*, as shown in FIGS. 3(B), 3(C) and 3(D).

(d) Cut each of the rubber-based fabric liners 24*a* to a predetermined size to form the construction liner 24 after the fabric liner 24*a* is cooled down to room temperature.

According to the preferred embodiment of the present invention, two fabric linings 242 are attached to both sides of the rubber piece 241 respectively, as shown in FIG. 3(B), wherein the two fabric linings 242 and the middle rubber piece 241 are overlapped and placed inside an elliptical shaped compression groove M1, in which the rubber piece 241, the fabric linings, and the compression groove M1 have identical shape and size that is larger than the size of the construction liner 24 to be produced. When the two pieces of the mold M is pressed together, as shown in FIG. 3(C), the two fabric linings 242 and the middle rubber piece 241 are compressed and vulcanized to firmly united integrally to form the single piece of rubber-based fabric liner 24*a* as shown in FIG. 3(D).

The thickness of the construction liner 24 is easily adjusted by changing the thickness of the rubber piece 241. When a thinner rubber piece 241 is used, the construction liner 24 to be made would have a stiffer property. Otherwise, when a thicker rubber piece 241 is used, the construction liner 24 to be made would have a softer nature. Moreover, more than one rubber piece 241 and/or more than two pieces fabric linings can be united to form a thicker and/or stiffer construction liner 24. Accordingly, if more rubber pieces 241 are used, a softer construction liner 24 is made. If more fabric linings 242 are used, a stiffer construction liner 24 is made. In other words, the softness or stiffness of the American ball of the present invention can thus be adjusted by controlling the thickness of the rubber piece 241 and the number of the rubber piece 241 and the fabric lining to be used.

For examples, two rubber pieces 241 can be placed between two fabric linings 242 and two rubber pieces 241 can be placed between three fabric linings 242 intervally. The fabric lining 242 is preferably made of woven fabric and has a thickness of, for example, 0.038 cm.

In order to produce the American ball as disclosed above with the construction liner 24 according to the present invention, the following steps can be processed after the above step (d).

(e) Provide a plurality of cover skins 23 each having a plurality of protruding pebbles 232 provided on a top surface 231 thereof, attach four said construction liners 24 on four inner surfaces of four said cover skins 23 to form four cover pieces 22 and sew the four cover pieces 22 edge to edge together to form the ball cover 20 by a sewing machine, in which a section of the ball cover 20 is not sewn to from an inlet opening 26, as shown in FIG. 3(E).

(f) Heat the ball cover 20 and turn the ball cover 20 right side out, as shown in FIG. 6(F).

(g) Insert the inflatable rubber bladder 30 into the ball cover 20 through the inlet opening 26, as shown in FIG. 6(F).

(h) Sew up the inlet opening 26 by hand to form the American football, as shown in FIG. 6(G).

In order to provide better attachment between the cover skin 23 and the construction liner 24, an additional step of adhering the construction liner 24 onto the cover skin 23 by rubber nature glue can be applied in the step (E).

In order to reinforce the surrounding portion of the inlet opening 26 of the ball cover 20, the following additional steps can be added the manufacturing method specified above.

(1) After step (e), sew two linings 271, 272 symmetrically around the inlet opening 26 and a reinforcing cloth underneath the inlet opening 26.

(2) After the above step (1), form a plurality of string holes 28 around the inlet opening 26, as shown in FIG. 3(G).

(3) After step (h), tighten a plurality of ball strings 29 around the string holes 28, as shown in FIG. 3(G).

As shown in FIG. 2, by means of vulcanization, the rubber piece 241 is entirely united with the fabric linings 242 to form an integral construction liner 24 with predetermined thickness. After the vulcanization, the fabric lining 242 can not be separated from the rubber any more. If more than one fabric linings 242 are used, the rubber 241 fills around the fabric threads of the fabric linings 242 so as to firmly joins the fabric linings 242 together to form a solid rubber-based fabric liner.

According to the preferred embodiment as disclosed above, the American football of the present invention can substantially achieved the following advantages:

1. It is more durable with better supporting but lower manufacturing cost because it is supported with improved construction liner which is made by vulcanization layers of rubber and fabric lining.

2. The stiffness and softness of the American football can be designated by adjusting the thickness of the rubber piece of the construction liner thereof and/or the number of layers of the rubber piece and the fabric lining, so that different types of American football with different levels of softness and stiffness can easily be made for fitting different types of playground and different ages of players.

3. The strong and inexpensive construction liner as introduced in the present invention is specifically designed and made for American football with controllable stiffness. It does not like the conventional liner that is simply made by sticking two fabric linings on both sides of a PU piece.

What is claimed is:

1. An American football manufacturing method, comprising the steps of:

(a) cutting a rubber sheet material into a plurality of elliptical rubber pieces each having a predetermined size;

(b) cutting a fabric sheet material into a plurality of elliptical fabric linings each having a same size of said rubber piece;

(c) compressing and vulcanizing each of said rubber pieces with at least one of said fabric linings together in a press mold, so as to firmly unite said rubber piece with said fabric lining integrally to form a rubber-based fabric liner;

(d) cutting each of said rubber-based fabric liners to a predetermined size to form a construction liner after said fabric liner is cooled down to room temperature;

(e) providing a plurality of cover skins each having a plurality of protruding pebbles provided on a top surface thereof, combining four said construction liners with four said cover skins to form four cover pieces by attaching said four construction liners on four inner surfaces of said four cover skins respectively, and sewing said four cover pieces edge to edge together to form said ball cover, in which a section of said ball cover is not sewn to form an inlet opening;

(f) heating said ball cover and turn said ball cover right side out;

(g) inserting an inflatable bladder into said ball cover through said inlet opening; and (h) sewing up said inlet opening to form an American football.

2. An American football manufacturing method, as recited in claim 1, further comprising an additional step of adhering said construction liner onto said cover skin by rubber nature glue.

3. An American football manufacturing method, as recited in claim 1, wherein each of said construction liners further comprises an additional fabric lining, said two fabric lining being attached on both sides of said rubber piece respectively, and said two fabric linings and said middle rubber piece are overlapped and placed inside an elliptical shaped compression groove of said press mold, in which said rubber piece, said fabric linings, and said compression groove have identical shape and size that is larger than the size of said construction liner to be produced, thereby when said two pieces of said press mold is pressed together.

4. An American football manufacturing method, as recited in claim 1, wherein each of said construction liners comprises a rubber piece of predetermined thickness and two fabric linings integrally attached to both sides of said rubber piece respectively, wherein said rubber piece and said two fabric linings are united to form said integral liner piece by compressing and vulcanizing.

5. An American football manufacturing method, as recited in claim 1, wherein each of said construction liners comprises an additional rubber piece and an additional fabric lining, said two rubber pieces being placed between said two fabric linings, wherein said two rubber pieces and said two fabric linings are united to form said integral liner piece by compressing and vulcanizing.

6. An American football manufacturing method, as recited in claim 1, wherein each of said construction liners further comprises an additional rubber piece and two additional fabric lining, said two rubber pieces being placed between said three fabric linings intervally, wherein said two rubber pieces and said three fabric linings are united to form said integral liner piece by compressing and vulcanizing.

7. An American football manufacturing method, as recited in claim 2, wherein each of said construction liners further comprises an additional fabric lining, wherein said two fabric linings are attached to both sides of said rubber piece respectively, and said two fabric linings and said middle rubber piece are overlapped and placed inside an elliptical shaped compression groove of said press mold, in which said rubber piece, said fabric linings, and said compression groove have identical shape and size that is larger than the size of said construction liner to be produced, thereby when said two pieces of said press mold is pressed together.

8. An American football manufacturing method, as recited in claim 2, wherein each of said construction liners further comprises an additional fabric lining, wherein said two fabric linings are attached to both sides of said rubber piece respectively, and that said rubber piece and said two fabric linings are united to form said integral liner piece by compressing and vulcanizing.

9. An American football manufacturing method, as recited in claim 2, wherein each of said construction liners further comprises an additional rubber piece and an additional fabric lining, wherein said two rubber pieces are placed between said two fabric linings, and that said two rubber pieces and said two fabric linings are united to form said integral liner piece by compressing and vulcanizing.

10. An American football manufacturing method, as recited in claim 2, wherein each of said construction liners further comprises an additional rubber piece and two more fabric linings, wherein said two rubber pieces are placed between said three fabric linings intervally, and that said two rubber pieces and said three fabric linings are united to form said integral liner piece by compressing and vulcanizing.

* * * * *